US009449451B2

(12) United States Patent
Hall

(10) Patent No.: US 9,449,451 B2
(45) Date of Patent: Sep. 20, 2016

(54) COIN IDENTIFIER

(71) Applicant: Michael J. Hall, Carol Stream, IL (US)

(72) Inventor: Michael J. Hall, Carol Stream, IL (US)

( * ) Notice: Subject to any disclaimer, the term of this patent is extended or adjusted under 35 U.S.C. 154(b) by 0 days.

(21) Appl. No.: 14/052,881

(22) Filed: Oct. 14, 2013

(65) Prior Publication Data

US 2015/0101907 A1 Apr. 16, 2015

(51) Int. Cl.

| | |
|---|---|
| ***G07D 5/00*** | (2006.01) |
| ***G07D 5/04*** | (2006.01) |
| ***G07D 5/02*** | (2006.01) |

(52) U.S. Cl.

CPC ..... *G07D 5/005* (2013.01); *G07D 5/02* (2013.01); *G07D 5/04* (2013.01)

(58) Field of Classification Search

CPC ..... G07D 5/00; G07D 5/005; G07D 5/02; G07D 5/04; G07D 5/08; G07D 13/00

USPC ..... 194/302, 303, 317, 320, 328, 334, 339; 73/163; 702/137, 156

See application file for complete search history.

(56) References Cited

U.S. PATENT DOCUMENTS

| | | | | |
|---|---|---|---|---|
| 5,910,044 | A * | 6/1999 | Luciano et al. | 453/32 |
| 6,520,308 | B1 * | 2/2003 | Martin et al. | 194/317 |
| 7,481,702 | B2 * | 1/2009 | Bell et al. | 453/16 |
| 2004/0003981 | A1 * | 1/2004 | Lee | 194/328 |
| 2004/0039663 | A1 * | 2/2004 | Kernz | G06F 17/30274 705/26.3 |
| 2011/0047062 | A1 * | 2/2011 | Kerschner et al. | 705/37 |
| 2014/0304156 | A1 * | 10/2014 | Geller et al. | 705/43 |
| 2015/0235499 | A1 * | 8/2015 | Grove | G07D 5/005 382/136 |

* cited by examiner

*Primary Examiner* — Mark Beauchaine

(74) *Attorney, Agent, or Firm* — Husch Blackwell LLP

(57) ABSTRACT

A method and apparatus including the steps of establishing a defining attributes of a respective coin based at least upon a predetermined ratio of weight per unit of volume or upon topological features of one or more predominant surfaces of the coin, measuring a first set of dimensional parameters that define a shape of the disk including one or more thickness and diameter measurements, measuring a second parameter including a weight of the disk, measuring a third set of parameters defining a set of topographical features of the disk, comparing the measured parameters within at least some of the plurality of files of the database; and classifying the disk as a specific type of coin by substantially matching at least some of the measured parameters of the disk with the attributes of at least one of the plurality of files.

20 Claims, 1 Drawing Sheet

COIN IDENTIFIER

FIELD

The field of the invention relates to coins and more particularly to methods of identifying coins.

BACKGROUND

Coin acceptors that authenticate coins are known. Such devices are typically used in vending machines to identify a currency value assigned to a coin and to validate the coin by confirming that the coin has a set of mechanical characteristics that are consistent with other coins from the same provider (e.g., the U.S. Mint).

The number of different coins accepted by coin acceptors is usually limited. Often quarters are the only coins accepted. Other more sophisticated machines may accept dimes, nickels and even pennies.

At least some coin acceptors may use a set of rails where coins are separated by height. In this case, the rail may have a top support only slightly higher than a dime thereby causing any dimes to fall through the rail into a dime validator. Pennies, nickels and quarters may be subsequently separated using the same concept.

Once separated, each coin may be validated by dropping the respective coins from a predetermined height and validating the respective coins based upon the impact produced. In this case, the impact is measured by the distance that a measuring place is moved by the dropped coin.

While coin validators work well, they are usually limited to the sale of a product. Accordingly, a need exists for more general methods of coin identification.

DETAILED DESCRIPTION OF AN ILLUSTRATED EMBODIMENT

Figure 1A:
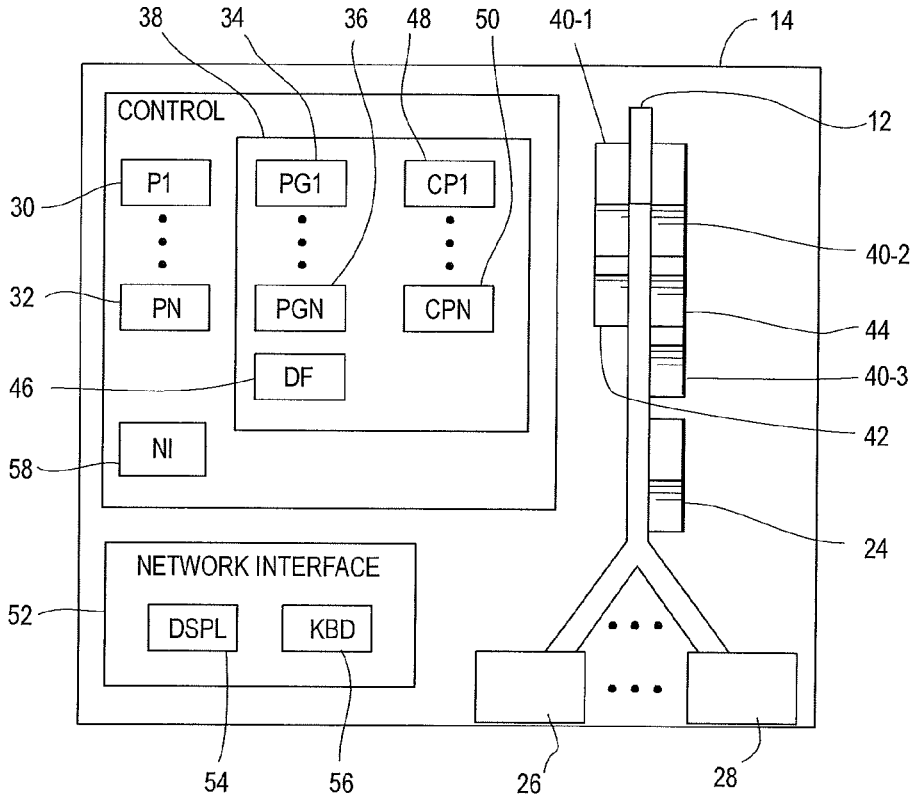
FIGS. 1*a* and 1*b* show front and side views of the function features of a coin identifier in accordance with an illustrated embodiment.

While embodiments can take many different forms, specific embodiments thereof are shown in the drawings and will be described herein in detail with the understanding that the present disclosure is to be considered as an exemplification of the principles hereof, as well as the best mode of practicing same. No limitation to the specific embodiment illustrated is intended.

Figure 1B:
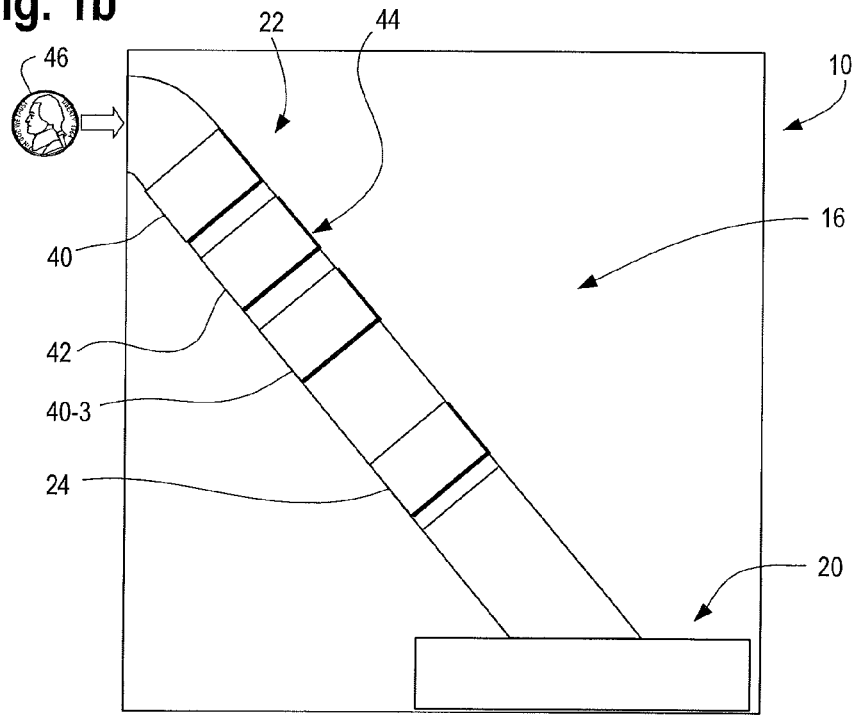

FIGS. 1*a-b* are front and side block diagrams that show functional aspects of a coin identifier 10 generally in accordance with an illustrated embodiment. The coin identifier of FIG. 1 differs from prior coin acceptors in a number of regards. For example, the coin identifier does not operate specifically to associate a currency value with coins inserted into the identifier. Instead, the identifier operates to identify coins based upon the material of the coin or upon the images on one or both predominant sides of the coin.

The coin identifier is not used in conjunction with the sale of a product. Instead, the identifier accepts any disk-like object that has the general shape of a coin and classifies the object based upon any of a number of different criteria provided by a user.

It should be specifically noted that while the term disk will be used herein to refer to the coin or other object inserted into the identifier, the identifier is not limited to circular coins or disks. In fact, the principles described below works equally well with oblong or square coins.

Turning now to the figures, FIG. 1 shows a coin slot 12 located on an outside surface of a housing 14 of the coin identifier. The slot has a length and width generally able to accept the largest coin that would be expected to be used with the coin identifier. For example, if the coin identifier were expected to be used for the identification of disks no larger than the U.S. quarter, then the slot would have a longitude of no more than about one inch and a width of no more than about 1/16 of an inch.

Inside the identifier, the coin slot connects to a chute 16 that slopes downward and into a number of selectable coin bins 20. It should be noted in this regard that the slope is sufficient to allow oblong or even square coins to easily slide down the chute.

Also associated with the chute may be a number of sensors 22. As the disk slides down the chute, the sensors collect information from the disk. The collected information may be used to trigger a diverter 24 that selects a bin 26, 28 of the selectable coin bins as a destination for the disk.

Included within the coin identifier is a number of processor apparatus (processors) 30, 32 each operating under control of one of one or more computer programs 34, 36 loaded from a non-transient computer readable medium (memory) 38. As used herein, reference to a step performed by a program is also reference to the processor that executed that step.

Also included within memory may be a number of coin parameter files 48, 50. For example, one of the coin parameters file may contain or specify an image located on an obverse and/or reverse side of the coin. Alternatively, one of the coin parameters file may simply specify a weight per unit volume that identifies a specific type of coin (e.g., gold). One or more classification processors 30, 32 may monitor the sensors 22 and classify each coin sliding down the chute by comparing the measured parameters with each of the coin parameter files.

Turning now to the sensors 22, the coin identifier may include one or more dimensional parameter sensors 40 that determine a weight per unit volume of the disk. The sensors may include a first sensor 40-1 that detects and measures a diameter and overall size and shape of a disk 46 inserted into the identifier. The sensor 40-1 may include an array of light emitting diodes (LED) and a corresponding array of photodetectors. A first portion 40-1 of the LEDs and photodiodes are arranged on opposing sides of the chute to measure the predominant dimensional parameters (e.g., the diameter of the disk). As the disk rolls (or slides) past the sensor 40-1, the sensors measure the area of the obverse and reverse sides of the disk based upon the number (area of) photodetectors that are blocked by the disk from receiving light from the corresponding LEDs. A second portion 40-2 of the LEDs and photodetectors measure the width of the disk.

A third sensor 40-3 may measure a weight of the disk. The third sensor may operate by temporarily blocking the progress of the disk down the chute while the weight of the disk is measured.

A dimensional processor may monitor the sensors 40 and save the measured parameters into a disk parameters file 46 in memory. Once saved, the dimensional processor may multiply the area by the width to determine the volume of the disk. The dimensional processor may then divide the weight of the disk by the volume to obtain the weight per unit volume. The dimensional processor may save the weight per unit volume into the disk file.

The sensors 22 may also include at least first and second cameras 42, 44 that capture images of one or both of the obverse and reverse sides of the disk. A third camera may capture images of the edge of the disk to identify the presence or absence of ridges. As images are collected from the cameras, they are saved as a set of topological parameters into the disk file.

One or more comparison and classification processors may compare the collected parameters with each of the files. Once a match is found, the classification processor activates the diverter to route the disk into the bin associated with the file.

It should be noted in this regard that the coin identifier may sort disks under any of a number of different methodologies. For example, one coin file 48, 50 may simply specify a weight per unit volume that identifies gold. Another coin file may identify silver. Still another coin file may classify the disk as a slug when the ratio of weight per unit volume does not conform to a precious metal or any known composition of a coin.

Even where the coin file specifies a material for identification, the file may specify a range of values. The range of values may be used to identify different percentages of the specified material (e.g., 14 carat gold, substantially pure gold, etc.).

Alternatively or in addition, the weight per unit volume may provide the basis for a further search along with other measured parameters. For example, if the disk were found to be gold of a predetermined percentage, then a search processor may be used to find coin files that contain those percentages along with image details that may be used to identify the particular type of gold coin.

In this regard, the images from the coin files may be compared with the images from the disk file. However, the matching need not be complete. For example, if the gold coin had been subject to extreme wear, then the image may only be partially visible. In this case, the reference image from the coin file may only need to be partially matched with the image within the disk file.

In other embodiments, a determination that the material of the disk is nickel may be used to identify rare coins that are made of nickel. In this case, the determination that the disk is nickel is used to retrieve coin files of nickel coins. As any matches are found, the disk is delivered to the bin associated with the matched coin.

Associated with the coin identifier may be a user interface 52. As matches are found, an identification of a coin and the bin where the matched coin has been delivered is shown on a display 54 of the user interface.

A keyboard 56 may also be used for creation of the coin files. An authorized user of the coin identifier may activate a browser within the coin identifier and access coin image files through the Internet using a network interface 58. In this way, the user may be able to download images and to create coin files that include the images of rare coins from any of a number of domestic or foreign sources.

In another embodiment, the dimensional parameter sensor 40 may include or be replaced by an eddy current sensor. In this regard, a materials processor may test the disk by cycling the eddy current sensor through a range of frequencies while measuring the eddy current response of the disk to determine the type of material of the disk and a weight per unit volume.

In another embodiment, a value processor may retrieve the saved parameters from the disk file and place a value on each processed disk. On a first level, the value processor may determine the amount of gold or silver in the disk (i.e., percentage and weight) and calculate a base value on that basis. The value processor may display the calculated value on the display and the identifier of the bin in which the disk has been delivered.

Alternatively, if the value processor can match the disk parameters (e.g., the images on the obverse and/or reverse sides of the coin) to one of the files, then the value processor may be able to retrieve a number of descriptors of the coin from the corresponding file including a commonly used identifier of the coin, the year the coin was minted, the mint coining the disk and the currency value of the disk. A search processor may use these descriptors to search a set of websites in order to identify the most recent public sale of similar coins. Based upon this search, the value processor may be able to display a probable value of the coin.

In general, the system may incorporate a number of steps including establishing a database including a plurality of files that each define attributes of a respective coin based at least upon a predetermined ratio of weight per unit of volume or upon topological features of one or more predominant surfaces of the coin, detecting a disk having the general size and shape of a coin, measuring a first set of dimensional parameters that define a shape of the disk including one or more thickness and diameter measurements, measuring a second parameter including a weight of the disk, measuring a third set of parameters defining a set of topographical features of the disk, comparing the measured parameters within at least some of the plurality of files of the database and classifying the disk as a specific type of coin by substantially matching at least some of the measured parameters of the disk with the attributes of at least one of the plurality of files.

Alternatively, the system may include a database including a plurality of files that each define attributes of a respective coin based at least upon a predetermined ratio of weight per unit of volume or upon topological features of one or more predominant surfaces of the coin, one or more sensors that measure a first set of dimensional parameters that define a shape of the disk including one or more thickness and diameter measurements and weight, a sensor that measures a second set of parameters defining a set of topographical features of the disk, a processor that compares the measured parameters within at least some of the plurality of files of the database and a processor that classifies the disk as a specific type of coin by substantially matching at least some of the measured parameters of the disk with the attributes of at least one of the plurality of files.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

The invention claimed is:

1. A method comprising:

establishing a database including a plurality of files that each define attributes of a respective coin based at least upon a predetermined ratio of weight per unit of volume and upon topological features of one or more predominant surfaces of the coin including downloading rare coin images from an internet to create the plurality of files that each include at least one of the downloaded coin images;

detecting a disk having the general size and shape of a coin;

measuring a first set of dimensional parameters that define a shape of the disk including one or more thickness and diameter measurements;

measuring a second parameter including a weight of the disk;

measuring a third set of parameters defining a set of topographical features of the disk;

comparing the measured parameters including an image of the disk within at least some of the plurality of files of the database;

classifying the disk as a specific type of coin based on a match to at least one of the downloaded coin images and by substantially matching at least some of the measured parameters of the disk with the attributes including at least one of the downloaded coin images of a matched one of the plurality of files, wherein the classification does not operate specifically to associate a currency value with the disk;

searching websites based upon the attributes including at least one image of the matched file to identify recent public sales of similar rare coins; and displaying a probable value of the disk based upon at least one most recent public sale of similar rare coins.

2. The method as in claim 1 further comprising using an edge camera to capture images of an edge of the disk to identify ridges on the edge of the disk.

3. The method as in claim 1 further comprising classifying the disk as a slug when the ratio of weight per unit volume does not conform to a precious metal or any known composition of a coin.

4. The method as in claim 1 further comprising selecting at least one of the plurality of files based upon a diameter of the disk.

5. The method as in claim 1 further comprising diverting the disk for further investigation based upon the classification.

6. The method as in claim 1 wherein the plurality of files further comprises a file with an attribute of the disk limited to a predetermined ratio of weight per unit of volume equal to an alloy of gold.

7. The method as in claim 6 further comprising testing the disk using eddy current analysis by cycling an eddy current sensor through a range of frequencies while measuring eddy current response of the disk to determine a composition of the disk.

8. The method as in claim 6 further comprising determining a coin image match based upon a partial match of one of the downloaded coin images.

9. An apparatus comprising:

a database including a plurality of files that each define attributes of a respective coin based at least upon a predetermined ratio of weight per unit of volume and upon topological features of one or more predominant surfaces of the coin including rare coin images downloaded from an internet to create the plurality of files that each include at least one of the downloaded rare coin images;

a sensor that detects a disk having the general size and shape of a coin;

one or more sensors that measure a first set of dimensional parameters that define a shape of the disk including one or more thickness and diameter measurements;

a sensor that measures a second parameter including a weight of the disk;

a sensor that measures a third set of parameters defining a set of topographical features of the disk;

a processor that compares the measured parameters including an image of the disk within at least some of the plurality of files of the database; and a processor that classifies the disk as a specific type of coin based upon a match to at least one of the downloaded coin images and by substantially matching at least some of the measured parameters of the disk with the attributes including at least one of the downloaded coin images of a matched one of the plurality of files wherein the classification does not operate specifically to associate a currency value with the disk and, instead, the processor searches websites based upon the attributes including at least one image of the matched file to identify recent public sales of similar rare coins and displays a probable value of the disk based upon at least one most recent public sale of similar rare coins.

10. The apparatus as in claim 9 further comprising a processor that classifies the disk as a slug when the ratio of weight per unit volume does not conform to a precious metal or any known composition of a coin.

11. The apparatus as in claim 9 further comprising a processor that selects at least one of the plurality of files based upon a diameter of the disk.

12. The apparatus as in claim 9 further comprising a diverter that diverts the disk for further investigation based upon the classification.

13. The apparatus as in claim 9 wherein the plurality of files further comprises a file with an attribute of the disk limited to a predetermined ratio of weight per unit of volume equal to an alloy of gold.

14. The apparatus as in claim 13 further comprising determining a composition of the disk using eddy current analysis by cycling an eddy current sensor through a range of frequencies while measuring the eddy current response of the disk.

15. The apparatus as in claim 13 further comprising a processor that determines a coin image match based upon a partial image match of one of the downloaded coin images.

16. The apparatus as in claim 13 further comprising an edge camera which captures images of an edge of the disk to identify ridges on the edge of the disk.

17. An apparatus comprising:

a database including a plurality of files that each define attributes of a respective coin based at least upon a predetermined ratio of weight per unit of volume and upon topological features of one or more predominant surfaces of the coin and the plurality of files including rare coin images downloaded from an internet;

one or more sensors that measure a first set of dimensional parameters that define a shape of the disk including one or more thickness and diameter measurements and weight;

a sensor that measures a second set of parameters defining a set of topographical features of the disk;

a processor that compares the measured parameters including an image of the disk within at least some of the plurality of files of the database; and a processor that classifies the disk as a specific type of coin based upon a match to at least one of the downloaded coin images and by substantially matching at least some of the measured parameters of the disk with the attributes including at least one of the downloaded coin images of a matched one of the plurality of files wherein the processor does not operate specifically to associate a currency value with the disk and, instead, the processor searches websites based upon the attributes including at least one image of the matched file to identify recent public sales of similar rare coins and displays a probable value of the disk based upon at least one most recent public sale of similar rare coins.

18. The apparatus as in claim 17 wherein at least one of the plurality of files contains an image of a particular type of coin.

19. The apparatus as in claim 17 further comprising an edge camera which captures images of an edge of the disk to identify ridges on the edge of the disk as one of the topographical features.

20. The apparatus as in claim 19 wherein at least one of the plurality of files identifies a particular type of gold coin.

* * * * *